United States Patent [19]

Morales

[11] 4,149,901

[45] Apr. 17, 1979

[54] POLLUTION CONTROL AND CONVECTION HEATER

[76] Inventor: Adolfo J. Morales, 6000 Leonardo St., Coral Gables, Fla. 33146

[21] Appl. No.: 839,804

[22] Filed: Oct. 6, 1977

[51] Int. Cl.[2] ..... C13D 3/00; C13D 3/10

[52] U.S. Cl. ..... 127/12; 55/241; 127/48; 261/108; 422/168

[58] Field of Search ..... 127/9, 11, 12, 48, 52; 55/240, 241; 261/108-111; 422/168

[56] References Cited

U.S. PATENT DOCUMENTS

| | | | |
|---|---|---|---|
| 1,271,914 | 7/1918 | Krafft | 127/12 X |
| 1,850,930 | 3/1932 | Heid | 261/110 |
| 2,596,104 | 5/1952 | Schneible | 261/109 X |
| 2,983,493 | 5/1961 | Handwerk | 261/109 |
| 2,983,494 | 5/1961 | Handwerk | 261/110 |
| 3,062,516 | 11/1962 | Hickman | 261/110 X |
| 3,218,046 | 11/1965 | Miers | 261/110 X |
| 3,782,080 | 1/1974 | Gallagher | 55/240 X |

FOREIGN PATENT DOCUMENTS

| | | | |
|---|---|---|---|
| 80392 | 4/1895 | Fed. Rep. of Germany | 127/12 |
| 1808105 | 3/1970 | Fed. Rep. of Germany | 261/110 |

*Primary Examiner*—Michael S. Marcus
*Attorney, Agent, or Firm*—Peck & Peck

[57] ABSTRACT

A smoke stack which receives at the lower end thereof dirty hot waste gases and receives adjacent the upper and thereof a constant flow of raw cold juice, the juice and the gases flowing in contra directions. A dual purpose is achieved since the cold juice flowing downwardly against the upward flow of the hot gases will result in the separation of charcoal and other impurities from the hot gas and the cold juice will be heated to the boiling point without the necessity of using separate fuel to produce steam for this purpose. Aiding in the purification of the gases and the heating of the juice causing a perfect mix between the up flowing gases and the down flowing juice are a series of vertically spaced apart peripheral trays or baffles and intermediate the series of peripheral trays are a plurality of central baffles or trays, the juice is fed onto the uppermost central tray, flows from the edges thereof to the next peripheral tray in a cascading manner, and due to these baffles the rising gases are caused to pursue a circuitous route for thoroughly mixing of the gas and juice. To accentuate this mixing the central trays are alternately of different configuration.

1 Claim, 3 Drawing Figures

POLLUTION CONTROL AND CONVECTION HEATER

SUMMARY OF THE INVENTION

This invention relates generally to a system for use with a smoke stack in which dirty hot waste gas flows upwardly and raw cold juice flows downwardly in a direction counter to the flow of the hot waste gases. Due to the novel construction of means provided within the smoke stack pollutants are eliminated from the dirty hot waste gases, while the raw cold juice which flows downwardly in the smoke stack in the opposite direction from the gas is heated to the boiling point without the necessity of using separate fuel to produce steam for this purpose.

Within the smoke stack are a plurality of particularly relatively disposed and spaced baffle members which produce a cascading effect on the juice and causes the upward flowing hot gases to pursue a circuitous route so that a thorough mixing of the gases and juice results to thereby produce the desired effects on both the upwardly flowing gas and the downwardly flowing juice.

Additional objects and advantages of the present invention will become more readily apparent to those skilled in the art when the following general statements and descriptions are read in the light of the appended drawings.

DETAILED DESCRIPTION

Figure 1:
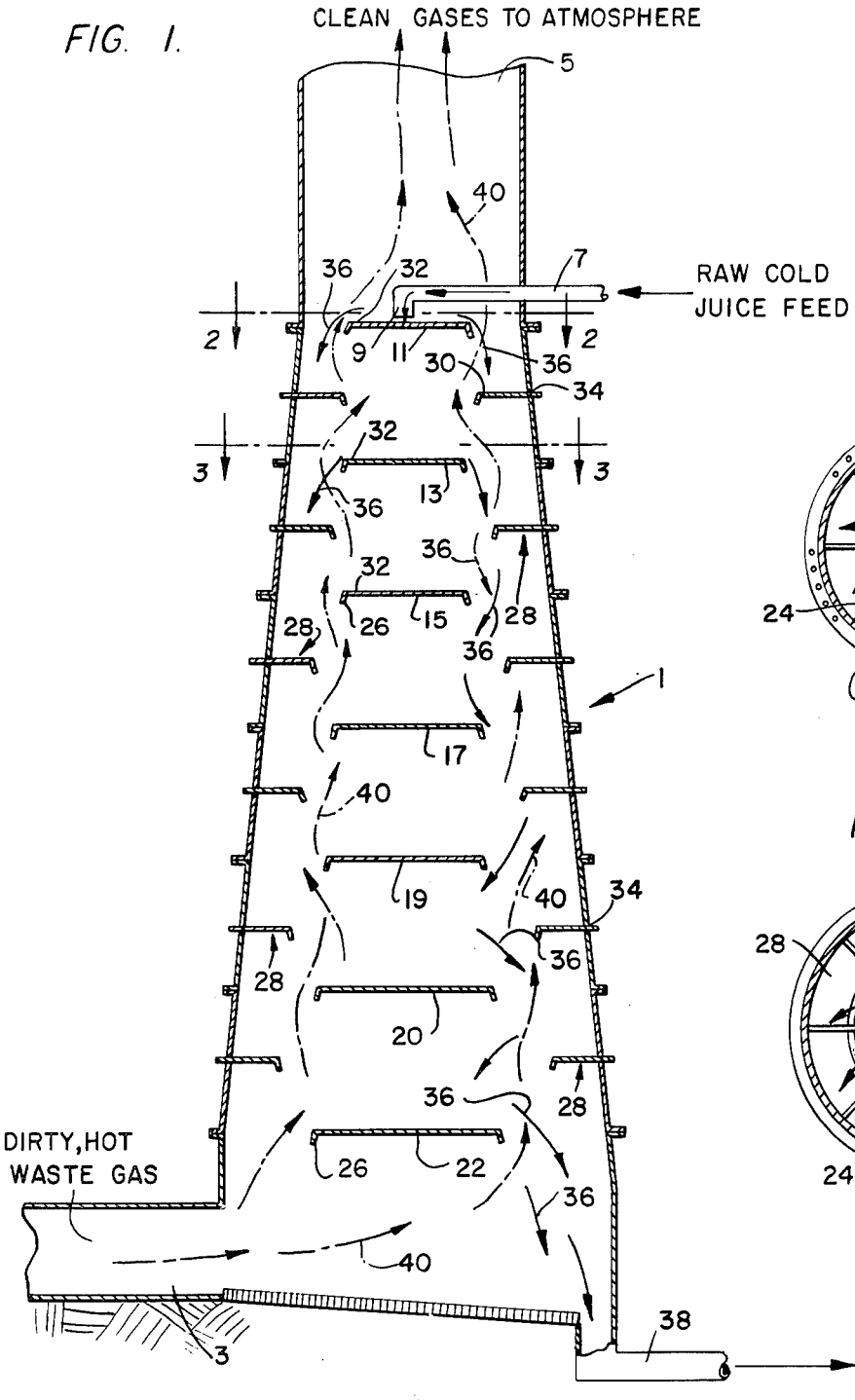
FIG. 1 is a vertical sectional view of the smoke stack with the means positioned therein for producing a cascading effect on the downwardly flowing juice and causing the upwardly flowing gas to pursue a circuitous course thoroughly mixing the juice and the gas.
Figure 2:
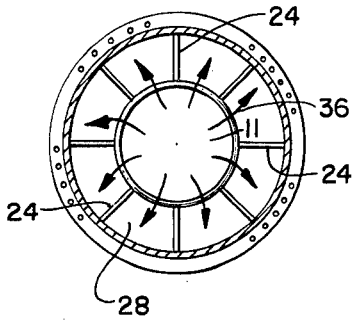
FIG. 2 is a view taken on the line 2—2 of FIG. 1.
Figure 3:
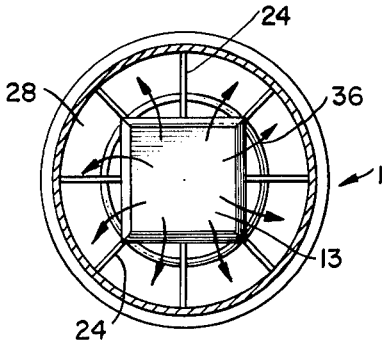
FIG. 3 is a view taken on the line 3—3 of FIG. 1.

In the accompanying drawings the numeral 1 has been used to designate in its entirety a smoke stack of generally conical configuration through which dirty hot waste gases are adapted to flow upwardly while raw cold cane juice is adapted to flow downwardly in the smoke stack. At the lower end of the smoke stack an inlet 3 is shown for feeding dirty hot waste gases into the smoke stack for upward flow therethrough out to the atmosphere as at 5. A feed line 7 extends through and into the upper central axial area of the smoke stack and is provided with a downwardly disposed outlet 9. The feed line 7 is adapted to feed raw cold juice into the smoke stack for counter flow of the juice downwardly against the upward flow of the dirty hot waste gas. This is done for purposes which will become apparent as this description proceeds. Positioned between the juice feed line 7 and the exit nose 9 therefor and the feed line 3 for the hot waste gases are a plurality of elements of novel type and arranged in a unique manner to cause a cascading effect upon the downward flowing juices and to cause the upwardly flowing hot gases to pursue a circuitous course so that a thorough mixing of the juices and the gases is accomplished. In this respect it will be appreciated, from consideration of the drawings, that the lower most of the elements which are provided for causing the cascading effect and the circuitous course of the gas is disposed adjacent to but upwardly spaced from the feed line 3 for the hot waste gases.

I provide a series of vertically spaced central trays or baffles which are designated by the numerals 11, 13, 15, 17, 19, 20 and 22. All of the baffles 11–22 are centrally disposed axially of the smoke stack 1 and due to the conical configuration of the smoke stack the central baffles are all slightly greater in diameter in descending order. Each central baffle 11–22 is supported by a plurality of arms 24 which are fixed in any suitable manner to the internal circumferential surface of the smoke stack and each of these arms at its inner end is fixed in any suitable manner to the central baffles. It is significant to note that the central baffles are all of differing configurations alternately, thus the uppermost central baffle 11 which is mounted closely to but slightly removed from the exit from the nose 9 is of circular configuration while the next central baffle 13 is of generally square or rectangular configuration while the baffle 15 is of circular configuration, the baffle 17 of rectangular configuration, the baffle 19 is of circular configuration, the baffle 20 is rectangular, and baffle 22 is circular. It is preferable, and provides a better cascading and mixing effect if each central baffle is provided with an annular downwardly depending lip 26 which extends from the edge of each body portion of each central baffle. It will be recognized that the number of central baffles which are used will depend upon the height of the smoke stack in which they are operatively positioned, but it is to be understood that the series of vertically spaced central baffles will have the above mentioned alternating different configurations. This differing configuration of the central baffles produces an excellent mix between the gas and the juice.

Disposed intermediately of the central baffles 11–22 and spaced from the baffles are a plurality of peripheral trays or baffles which I have designated generally by the numeral 28. These peripheral baffles are generally of annular configuration and are fixed in any suitable manner to the wall of the smoke stack and extend into the interior thereof a distance. It will be noted that the inner edge 30 of the uppermost peripheral baffle 28 is in substantially the same vertical plane as the edge 32 of the uppermost central baffle 11, while the inner edges 30 of the remaining peripheral baffles, in descending order, are outside the vertical planes of the edges 32 of the central baffles 13–20. While I have illustrated the outer edge of each peripheral baffle 28 as extending through the smoke stack wall as at 34, this is shown in this manner merely as an example and is not to be construed as a limitation. The inner edge of each peripheral baffle 28 is preferably formed with a downward depending lip 36 which, as will become evident as this description proceeds, enhances the mixing of the gas with the juice and also contributes to the cascading effect of the juice.

When the apparatus is operating the raw cold juice, which may be sugar cane juice, is fed through the pipe 7 and exit nose 9 and falls directly upon the central portion of the uppermost central baffle 11 which, as has been explained, is of circular configuration. The juice falls from this central baffle 11 on to the intermediately disposed peripheral baffle 28 as illustrated by the arrows 36 and from this peripheral baffle the juice flows in a cascading manner to the baffle 13 which is of rectangular configuration. Now it will be understood from consideration of the drawings that the down flowing juices will cascade from the central baffles to the next adjacent peripheral baffle into the lowermost baffle 22 from which the juices will flow from the smoke stack through an outlet pipe 38 from whence it may flow to a clarification means. The hot gases which are flowing upwardly in the smoke stack are indicated by the arrows 40 and it will be recognized that in the upward flow the gases will pursue a circuitous course because of the central baffles and the peripheral baffles so that a complete and thorough mixing of the gases with the juices will be effected and the juices which flow out the exit line 38 will be hot and the gases exiting from the smoke stack as at 5 will be clean and non-polluting.

It will now be appreciated that this apparatus serves a dual function since it not only purifies and eliminates pollutants from the dirty hot waste gases, but it heats the raw sugar cane juice using the otherwise wasted heat of the gases and utilizes the $CO_2$ in the gas to clarify the juice. Thus the pollution elimination resulting from the apparatus while of substantial significance is an indirect result of the heating and clarifying of raw sugar cane juice in the sugar fabrication process.

What is claimed is:

1. A smoke stack, including in combination a feed inlet at the bottom thereof for feeding dirty hot waste gas into the lower end of the smoke stack for upward flow and purification of said gas for exit from the top of the smoke stack, means adjacent to but downwardly disposed relative to the top of the smoke stack for feeding raw cold juice into the smoke stack for flow downwardly therein counter to the flow of the ascending hot waste gas for the heating of the raw cold juice, means at the bottom of the smoke stack for flow of the heated juice therefrom, a vertical series of spaced apart central baffles mounted in said smoke stack, the outer edge of each baffle being spaced from the wall of the smoke stack, the uppermost central baffle of said series of central baffles is of circular configuration and the next lower adjacent central baffle is of rectangular configuration, and this differing configuration is followed alternately through the remaining central baffles of the series of central baffles, and a vertical series of spaced apart peripheral baffles mounted on and extending inwardly a distance from the wall of the smoke stack, a peripheral baffle of said series of peripheral baffles being disposed in spaced relation to and between each pair of adjacent central baffles, the juice feed means directing the juice on to the uppermost circular central baffle of the series of baffles, whereby the juice descends in the smoke stack from a central baffle to the next adjacent peripheral baffle and then to the next adjacent central baffle and so on through the series of central baffles and peripheral baffles in a cascading manner, while the gas flows upwardly against the descending juice and is caused by the baffles to pursue a circuitous course in the smoke stack for complete mixing of the juices and the gas and heating the juice, and the inner edge of said uppermost peripheral baffle is substantially in the vertical plane of the outer edge of said uppermost central baffle, the inner edges of the remaining peripheral baffles being outside the vertical planes of the edges of the remaining central baffles.

* * * * *